United States Patent [19]

Morgan et al.

[11] 4,369,026

[45] Jan. 18, 1983

[54] CONTROL OF THE FUEL/OXYGEN RATIO FOR A COMBUSTION PROCESS

[75] Inventors: John A. Morgan; Henry K. Hachmuth, both of Bartlesville, Okla.

[73] Assignee: Phillips Petroleum Company, Bartlesville, Okla.

[21] Appl. No.: 123,230

[22] Filed: Feb. 21, 1980

[51] Int. Cl.[3] ..... F23N 1/02

[52] U.S. Cl. ..... 431/12; 431/89

[58] Field of Search ..... 431/89, 12, 18

[56] References Cited

U.S. PATENT DOCUMENTS

| | | | |
|---|---|---|---|
| 3,236,449 | 2/1966 | Brunner | 236/15 |
| 3,420,510 | 1/1969 | Griem . | |
| 3,602,487 | 8/1971 | Johnson | 431/12 |
| 3,607,117 | 9/1971 | Shaw | 431/12 |
| 4,069,413 | 1/1978 | Rutledge et al. | 364/118 |

OTHER PUBLICATIONS

Leeds & Northrup Application Memo E6.0001-AM, Nov. 1976-Centry Lead-Lag Fuel Air Ratio for Combustion Processes.

Oil & Gas Journal, Air-Preheater System Controls Heater Fuel/Air Ratio, C. D. Spangler, B. A. Christensen, Continental Oil Co., Petroleum Publishing Co., Jan. 5, 1976.

Combustion Optimizers-Forney Industrial Systems and Products Div., 14211 Proton Rd., Dallas, Texas 75240.

*Primary Examiner*—Carroll B. Dority, Jr.

[57] ABSTRACT

A desired oxygen/fuel ratio is maintained for a combustion process when the heat required from the combustion process is substantially constant. Excess oxygen is provided to the combustion process in response to an increasing fuel flow resulting from an increase in the heat required of the combustion process by initiating an increase in the flow of an oxygen-containing fluid before the fuel flow rate is increased in response to an increasing heat requirement. When the heat required of the combustion process is decreasing, the reduction in the flow rate of the fuel is initiated prior to initiating a reduction in the flow rate of the oxygen-containing fluid. In this manner, excess oxygen is provided to a combustion process even when the fuel flow rate is not at a steady-state condition.

9 Claims, 2 Drawing Figures

CONTROL OF THE FUEL/OXYGEN RATIO FOR A COMBUSTION PROCESS

Figure 1:
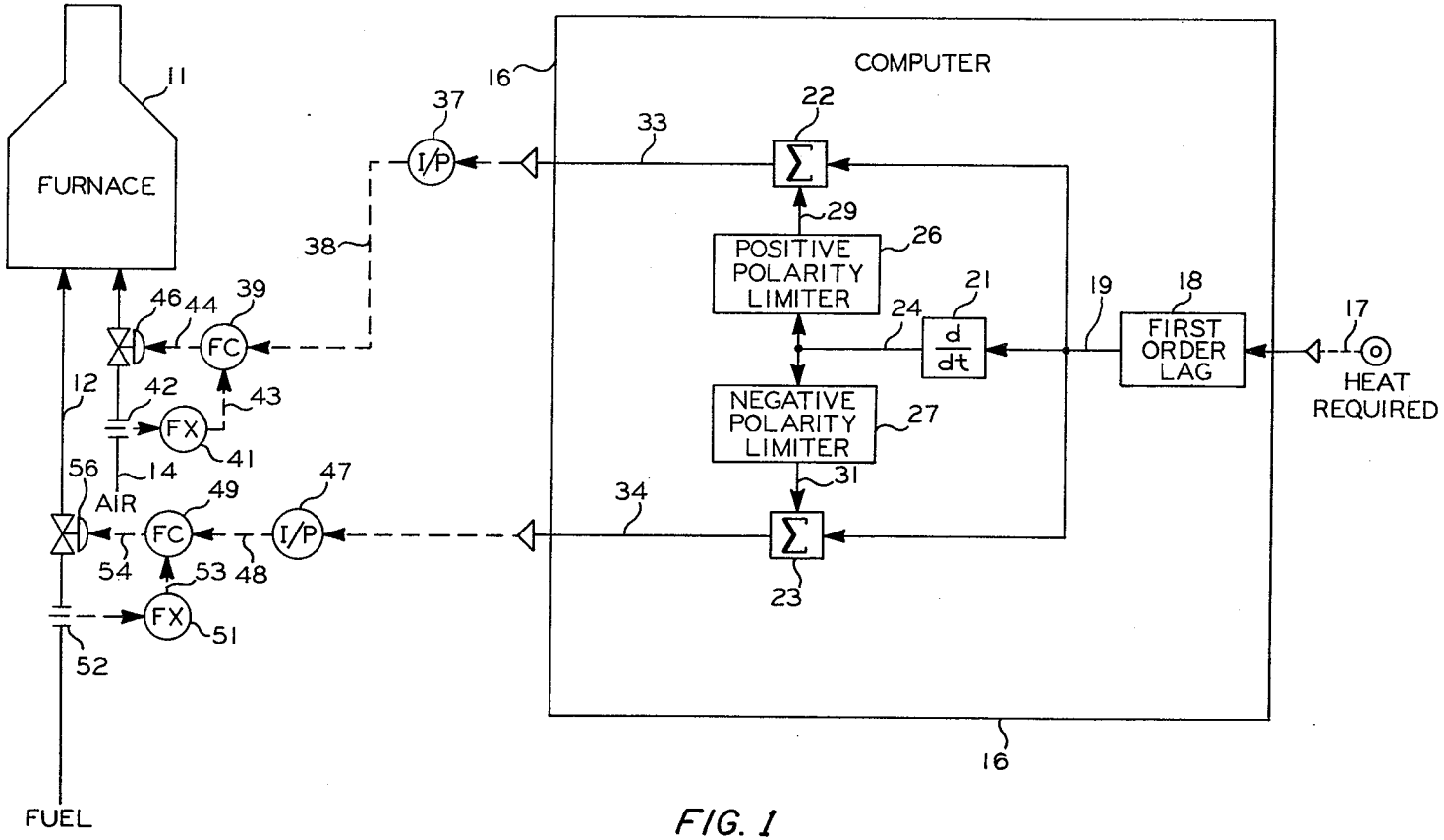

This invention relates to method and apparatus for controlling the flow of fuel and an oxygen-containing fluid to a combustion process. In a particular aspect, this invention relates to method and apparatus for insuring that excess oxygen is provided to a combustion process during periods of changing fuel flows resulting from changes in the heat required from the combustion process.

For maximum fuel efficiency, it is desirable to fire combustion processes with minimum excess oxygen during static or steady-state load conditions. However, to assure that the combustion process does not go into a fuel-rich state during increasing or decreasing load requirements which might violate environmental and safety restrictions, it is necessary to provide excess combustion oxygen during these transient firing states. It is thus an object of this invention to provide method and apparatus for insuring that excess oxygen is provided to a combustion process during periods of changing fuel flows resulting from changes in the heat required from the combustion process.

As used herein, the term "excess oxygen" refers to oxygen in excess of the stoichiometric amount of oxygen required to combust the fuel being supplied to the combustion process. Air is preferred for supplying the oxygen required by the combustion process. However, any fluid containing free oxygen could be utilized if desired.

In accordance with the present invention, method and apparatus is provided whereby a signal which is representative of the heat required from the combustion process is lagged to produce a lagged required heat signal. The lagged required heat signal is then differentiated and the resulting signal is provided to both a positive polarity limiter and a negative polarity limiter. The output from the positive polarity limiter and the output from the negative polarity limiter are separately summed with the lagged required heat signal. The summation of the output from the positive polarity limiter and the lagged required heat signal is utilized to provide a set point to the controller manipulating the flow of an oxygen-containing fluid to the combustion process. The summation of the output of the negative polarity limiter and the lagged required heat signal is utilized to provide a set point to the controller manipulating the flow of fuel to the combustion process.

When the heat required of the combustion process is increasing so as to require an increased fuel flow to the combustion process, the output of the positive polarity limiter will track the output of the differentiator. However, the output of the negative polarity limiter will remain zero during times when the heat required is increasing. Thus, the set point signal to the oxygen-containing fluid flow controller will track the required heat signal while the set point signal to the fuel flow controller will be delayed by the lag. Thus, the oxygen-containing fluid flow to the furnace is increased before the fuel flow to the furnace is increased keeping a safe, excess air condition.

When the heat required from the combustion process is decreasing which results in a decreased fuel flow to the combustion process, the output of the negative polarity limiter will track the output of the differentiator while the output of the positive polarity limiter will remain zero. Thus, the set point to the fuel flow controller will track the required heat signal while the set point to the oxygen-containing fluid flow controller will be delayed by the lag. The flow rate of fuel to the furnace will thus be decreased before the flow rate of oxygen-containing fluid to the furnace is decreased which will again provide a safe, excess air condition.

Essentially, the control system of the present invention maintains a desired fuel/oxygen ratio during periods of steady-state load conditions. When process disturbances cause a change in the required fuel flow, the control system of the present invention insures that excess oxygen is available during the transition period. When steady-state operation is again reached the desired fuel/oxygen ratio will again be maintained at the new fuel flow rate.

Figure 2:
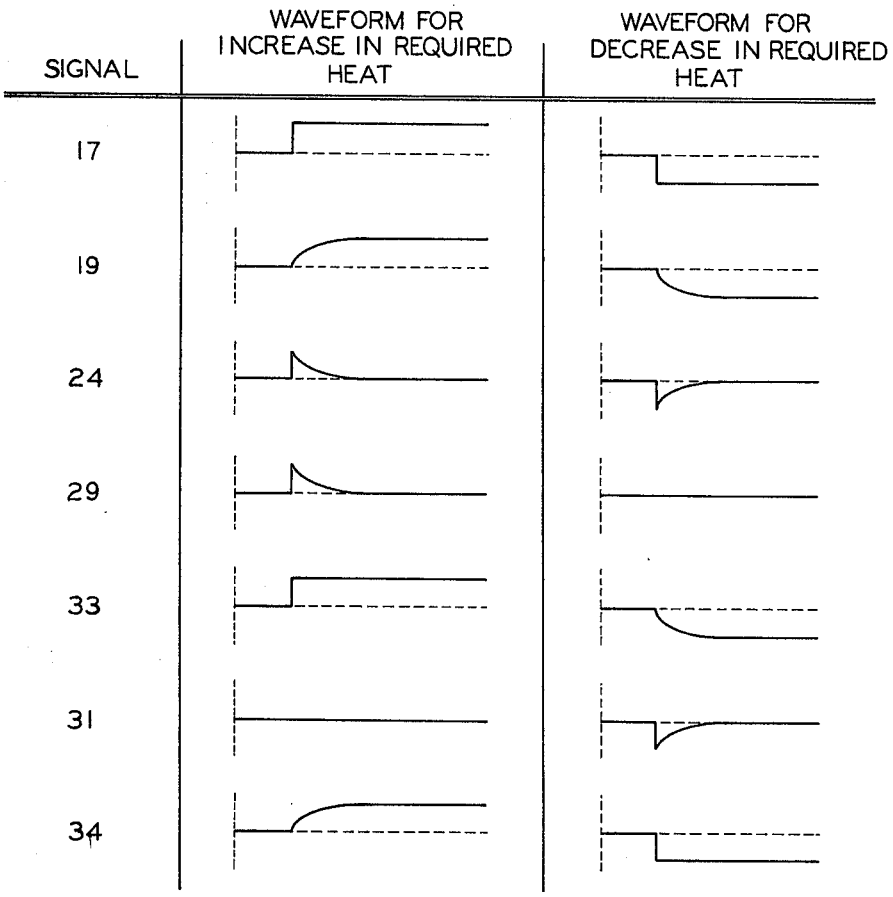

Other objects and advantages of the invention will be apparent from the foregoing brief description of the invention and the claims as well as from the detailed description of the drawings in which:

FIG. 1 is a diagrammatic illustration of a combustion process and the control system of the present invention; and FIG. 2 is a graphical representation of the signals generated by the analog computer illustrated in FIG. 1 when the heat required from the combustion process is increasing or decreasing.

The invention is illustrated and described in terms of a furnace to which both fuel and air is supplied. However, the invention is applicable to other types of combustion processes which require the control of the fuel/oxygen ratio. The invention is also described in terms of a combustion process in which air is utilized to supply free oxygen. However, the invention is applicable to the use of any suitable fluid containing free oxygen to supply the oxygen required by the combustion process.

The invention is also described in terms of using a first order exponential lag. However, any suitable lag could be utilized.

An analog computer is used in the preferred embodiment of this invention to calculate the required control signals. Preferably, the analog computer is the Optrol A 401 Electronic Analog Control Computer which is manufactured by Applied Automation, Inc., Bartlesville, Oklahoma. Digital computers or other types of computing devices could also be used in the present invention.

The controllers shown may utilize the various modes of control such as proportional, proportional-integral, proportional-derivative, or proportional-integral-derivative. In this preferred embodiment, proportional-integral controllers are utilized but any controller capable of accepting two input signals and producing a scaled output signal, representative of a comparison of the two input signals, is within the scope of the invention. The operation of proportional-integral controllers is well known in the art. The output control signal of a proportional-integral controller may be represented as $$S=K_1E+K_2\int Edt$$

where

S=output control signals;

E=difference between two input signals; and $K_1$ and $K_2$=constants.

Referring now to the drawings, and in particular to FIG. 1, there is illustrated a furnace 11 to which fuel is supplied through conduit means 12 and air is supplied through conduit means 14. An analog computer 16 is utilized to derive the set point signals required to control the flow of fuel and air to the furnace 11.

The computer 16 is provided with a heat required signal 17 which is representative of the heat required of the combustion process occurring in the furnace 11. The heat required signal 17 may be supplied by an operator or may be derived from the particular process which is being supplied heat from the furnace 11. Signal 17 is provided as an input to the first order exponential lag means 18. Signal 19, which is representative of the lagged heat required signal, is supplied from the first order lag means 18 as an input to the differentiator 21, the summing block 22 and the summing block 23. Signal 19 is differentiated with respect to time to produce signal 24 which is provided from the differentiator 21 as an input to the positive polarity limiter 26 and the negative polarity limiter 27. The output signal 29 from the positive polarity limiter 26 is provided as an input to the summing block 22. The output signal 31 from the negative polarity limiter 27 is provided as an input to the summing block 23. Signals 19 and 29 are summed in the summing block 22 to provide signal 33 which is representative of the desired flow rate of the air flowing through conduit means 14. In like manner, signals 19 and 31 are summed in the summing block 23 to provide signal 34 which is representative of the desired flow rate of the fuel flowing through conduit means 12.

Signal 33 is provided from the computer 16 as an input to the current-to-pressure (I/P) transducer 37. Signal 33 is converted from electrical form to pneumatic form and is provided as signal 38 to the flow controller 39. The flow transducer 41, in combination with the flow sensor 42 which is operably located in conduit means 14, provides an output signal 43 which is representative of the actual flow rate of the air flowing through conduit means 14. Signal 43 is provided from the flow transducer 41 as an input to the flow controller 39. The flow controller 39 provides an output signal 44 which is responsive to the difference between signals 43 and 38. Signal 44 is provided as a control signal to the pneumatic control valve 46 which is operably located in conduit means 14. The pneumatic control valve 46 is manipulated in response to signal 44 to thereby maintain the actual flow rate of the air flowing through conduit means 14 substantially equal to the flow rate represented by the set point signal 38.

Signal 34 is provided from the computer 16 as an input to the current-to-pressure (I/P) transducer 47. Signal 34 is converted from electrical form to pneumatic form and is provided as signal 48 to the flow controller 49. The flow transducer 51, in combination with the flow sensor 52 which is operably located in conduit means 12, provides an output signal 53 which is representative of the actual flow rate of the fuel flowing through conduit means 12. Signal 53 is provided from the flow transducer 51 as an input to the flow controller 49. The flow controller 49 provides an output signal 54 which is responsive to the difference between signals 53 and 48. Signal 54 is provided as a control signal to the pneumatic control valve 56 which is operably located in conduit means 12. The pneumatic control valve 56 is manipulated in response to signal 54 to thereby maintain the actual flow rate of the fuel flowing through conduit means 12 substantially equal to the flow rate represented by the set point signal 48.

FIG. 2 will be referred to in conjunction with FIG. 1 in order to more fully describe the present invention. The required heat signal 17 is illustrated in FIG. 2 as a step increase when the heat required from the furnace 11 is increasing. The required heat signal 17 could have other waveforms but the present invention is most conveniently illustrated in terms of a step waveform. Referring only to the portion of FIG. 2 which illustrates the waveforms for the various signals when the required heat is increasing, signal 19 from the first order lag will effectively be a delayed response to the step increase of signal 17. Signal 19 will begin slowly to increase when signal 17 increases and will over a period of time reach the magnitude of signal 17. Signal 24 from the differentiator 21 will take the form of essentially the inverse of signal 19. Signal 29 will track signal 24 because signal 24 is positive. However, signal 31 will remain zero because of the negative polarity limiter 27. The summation of signal 19 and signal 29 gives the step waveform of signal 33. Effectively, signal 33 tracks signal 17. The summation of signals 19 and 31 gives the waveform of signal 34. Effectively, signal 34 tracks signal 19. It can thus be seen that signal 33 will cause the flow rate of the air to immediately increase in response to the step change in the required heat signal 17. In contrast, the flow rate of the fuel to the furnace 11 will be caused to slowly increase to a desired level by the waveform of signal 34. Effectively, the increase in the flow rate of the fuel is delayed by the delay inherent in the first order lag 18 while the flow rate of the air is not effected by the delay in the first order lag 18 when the required heat signal 17 increases.

Referring now to the portion of FIG. 2 which relates to the waveforms which are generated when the required heat signal 17 decreases, the required heat signal 17 is again illustrated as a step function. However, the step function is negative when the required heat signal 17 decreases. Signal 17 is lagged to produce signal 19 which is effectively a delayed response to the negative decrease in the required heat. The derivative of signal 19 is negative and thus signal 29 will be zero while signal 31 will track signal 24. The summation of signals 29 and 19 provides the control signal 33 which delays the decrease in the flow rate of the air flowing to the furnace 11 by a factor given by the delay inherent in the first order lag 18. The summation of signals 19 and 31 provides the control signal 34 which effectively tracks the required heat signal 17. Thus, when the heat required of the furnace 11 decreases, the fuel flow will be quickly decreased but the air flow will be decreased slowly over a period of time to thus insure that excess air is provided during the transition.

The invention has been described in terms of a preferred embodiment as illustrated in FIGS. 1 and 2. Specific components used in the practice of the invention as illustrated in FIG. 1 such as flow sensors 52 and 42, flow transducers 51 and 41, flow controllers 39 and 49, pneumatic control valves 46 and 56, and I/P transducers 37 and 47 are each well known, commercially available control components such as are described at length in *Perry's Chemical Engineer's Handbook*, 4th edition, chapter 22, McGraw-Hill.

For reasons of brevity, the process with which the furnace 11 may be associated has been deleted. Also, pumps and other conventional equipment which may be associated with the furnace 11 have been deleted as they play no part in the explanation of the invention.

While the invention has been described in terms of the presently preferred embodiment, reasonable variations and modifications are possible by those skilled in the art within the scope of the described invention and the appended claims.

That which is claimed is:

1. Apparatus comprising:
means for combusting a fuel;
means for supplying fuel to said means for combusting a fuel;
means for supplying a fluid containing free oxygen to said means for combusting a fuel;
means for establishing a first signal which is representative of the heat which must be supplied from said means for combusting a fuel;
a lag means;
means for supplying said first signal as an input to said lag means, said lag means establishing a second signal representative of a lagged required heat signal;
a differentiator means;
a first summing means;
a second summing means;
means for supplying said second signal from said lag means as an input to said differentiator means, said first summing means, and said second summing means, said differentiator means establishing a third signal which is representative of the derivative with respect to time of said second signal;
a positive polarity limiter means;
a negative polarity limiter means;
means for supplying said third signal from said differentiator means as an input to said positive polarity limiter means and said negative polarity limiter means, said positive polarity limiter means establishing a fourth signal which is representative of the positive portion of said third signal, said negative polarity limiter means establishing a fifth signal which is representative of the negative portion of said third signal;
means for supplying said fourth signal from said positive polarity limiter means to said first summing means, said first summing means establishing a sixth signal which is representative of the summation of said second signal and said fourth signal;
means for supplying said fifth signal from said negative polarity limiter means to said second summing means, said second summing means establishing a seventh signal which is representative of the summation of said second signal and said fifth signal;
means for manipulating the flow rate of said fuel to said means for combusting a fuel in response to said seventh signal; and
means for manipulating the flow rate of said fluid-containing oxygen to said means for combusting a fuel in response to said sixth signal.

2. Apparatus in accordance with claim 1 wherein said means for combusting a fuel is a furnace means and said fluid containing free oxygen is air.

3. Apparatus in accordance with claim 1 wherein said lag means is a first order exponential lag means.

4. Apparatus in accordance with claim 1 wherein said means for manipulating the flow rate of said fuel in response to said seventh signal comprises:
means for establishing an eighth signal representative of the actual flow rate of said fuel;
means for comparing said eighth signal and said seventh signal and for establishing a ninth signal responsive to the difference between said seventh signal and said eighth signal; and
means for manipulating the flow rate of said fuel in response to said ninth signal.

5. Apparatus in accordance with claim 4 wherein said means for manipulating the flow rate of said fluid containing free oxygen in response to said sixth signal comprises:
means for establishing a tenth signal representative of the actual flow rate of said fluid containing free oxygen;
means for comparing said sixth signal and said tenth signal and for establishing an eleventh signal responsive to the difference between said sixth signal and said tenth signal; and
means for manipulating the flow rate of said fluid containing free oxygen in response to said eleventh signal.

6. A method for maintaining a desired fuel-to-oxygen ratio in a combustion process when the flow rate of said fuel to said combustion process is substantially constant and for insuring that excess oxygen is provided to said combustion process during periods of changing fuel flow resulting from changes in the heat required from said combustion process, said method comprising the steps of:
establishing a first signal which is representative of the heat which must be supplied from said combustion process;
lagging said first signal to thereby establish a second signal;
differentiating said second signal with respect to time to thereby establish a third signal;
summing any positive portion of said third signal with said second signal to thereby establish a fourth signal;
summing any negative portion of said third signal with said second signal to thereby establish a fifth signal;
manipulating the flow rate of fuel to said combustion process in response to said fifth signal; and
manipulating the flow rate of a fluid containing free oxygen to said combustion process in response to said fourth signal.

7. A process in accordance with claim 6 wherein said fluid containing free oxygen is air.

8. A process in accordance with claim 6 wherein said step of manipulating the flow rate of said fuel to said combustion process in response to said fifth signal comprises:
establishing a sixth signal representative of the actual flow rate of said fuel to said combustion process;
comparing said fifth signal and said sixth signal and establishing a seventh signal responsive to the difference between said fifth signal and said sixth signal; and
manipulating the flow rate of said fuel to said combustion process in response to said seventh signal.

9. A process in accordance with claim 8 wherein said step of manipulating the flow rate of said fluid containing free oxygen to said combustion process in response to said fourth signal comprises:
establishing an eighth signal representative of the actual flow rate of said fluid containing free oxygen to said combustion process;
comparing said fourth signal and said eighth signal and establishing a ninth signal responsive to the difference between said fourth signal and said eighth signal; and
manipulating the flow rate of said fluid containing free oxygen to said combustion process in response to said ninth signal.

* * * * *